United States Patent [19]

Matsuyama

[11] 3,993,240

[45] Nov. 23, 1976

[54] BLANKS FOR FORMING A RECTANGULAR BOX AND LID

[75] Inventor: Glen Matsuyama, Los Angeles, Calif.

[73] Assignee: Graphic Arts Packaging Corporation, Gardena, Calif.

[22] Filed: Dec. 10, 1975

[21] Appl. No.: 639,387

[52] U.S. Cl. ..... 229/23 BT; 229/43

[51] Int. Cl.[2] ..... B65D 43/04; B65D 13/04

[58] Field of Search ..... 229/23 BT, 23 R, 43

[56] References Cited

UNITED STATES PATENTS

| | | | |
|---|---|---|---|
| 2,722,310 | 11/1955 | Smith | 229/23 R X |
| 2,729,384 | 1/1956 | George et al. | 229/23 R |
| 2,899,120 | 8/1959 | James | 229/23 R |
| 2,983,423 | 5/1961 | Vail | 229/23 R |
| 3,115,292 | 12/1963 | Repking | 229/23 BT X |
| 3,144,189 | 8/1964 | Bartz | 229/23 BT |
| 3,767,109 | 10/1973 | Paige | 229/43 |

*Primary Examiner*—Davis T. Moorhead
*Attorney, Agent, or Firm*—Keith D. Beecher

[57] ABSTRACT

Three blanks are provided which may be composed of paperboard, or other suitable material, and which are used to form a rectangular box with a rectangular detachable lid.

5 Claims, 4 Drawing Figures

BLANKS FOR FORMING A RECTANGULAR BOX AND LID

BACKGROUND OF THE INVENTION

The three blanks of the invention are each appropriately shaped, slit, perforated and scored so that each may be folded into the desired configuration in a suitable folding and gluing machine. When folded, the entire external surface of the box and lid corresponds to one side only of the individual blanks, so that appropriate decorative and informative information may be printed on the blanks by a single one-sided printing operation.

The resulting box is made with a minimum of gluing operations, yet it is sturdy and strong, and it is capable of relatively rough usage without tearing, crushing or losing its shape.

DETAILED DESCRIPTION OF THE ILLUSTRATED EMBODIMENT

Figure 1:
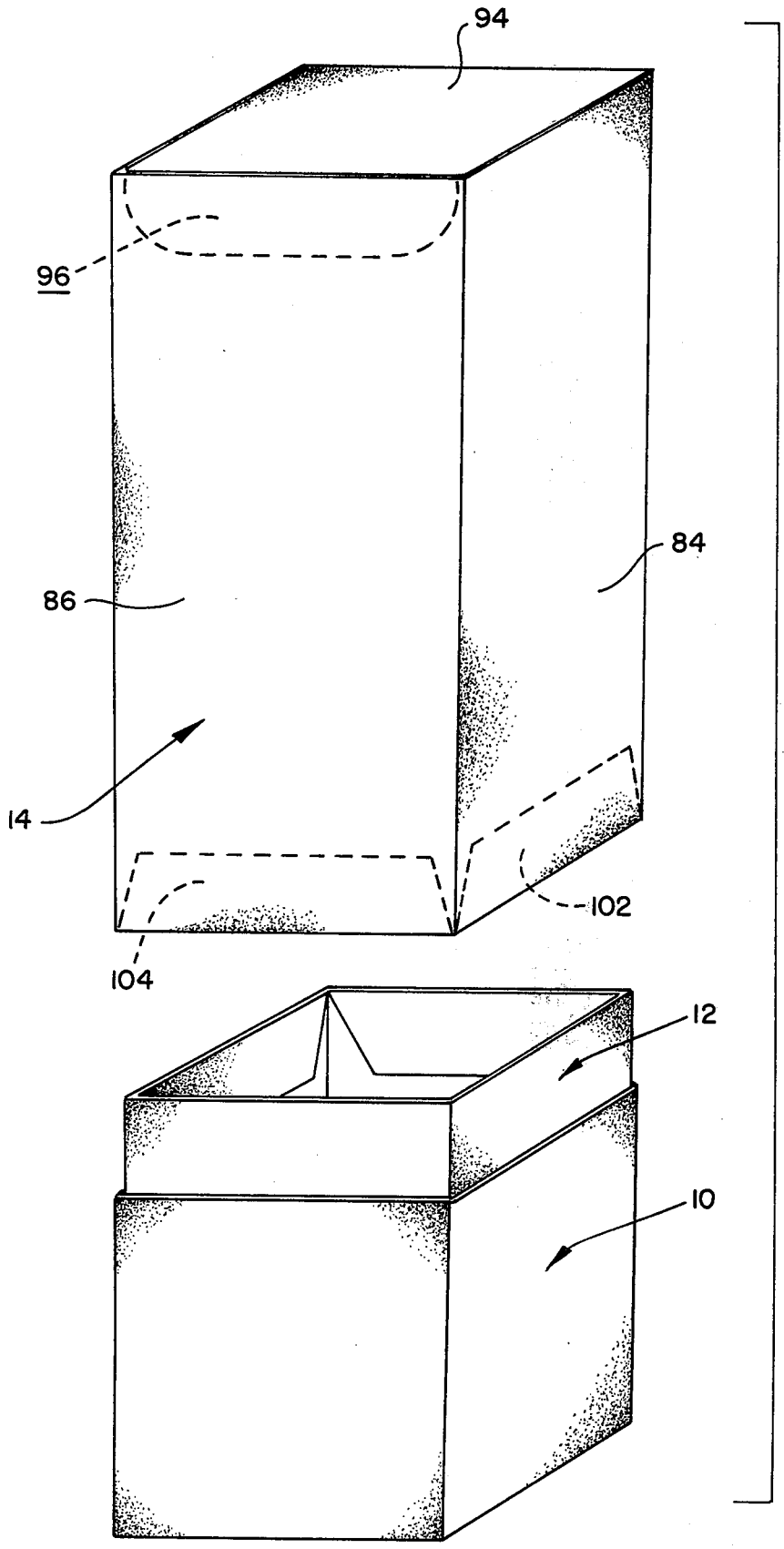
FIG. 1 is a perspective representation of a box and lid constituting one embodiment of the invention, the box being shown with the lid detached therefrom.

The representation of FIG. 1 includes a rectangular box 10 having a rectangular insert 12, and a rectangular lid 14. The lid 14 is detachable from the box. The lid has the same cross-sectional dimensions as the box, so that it may be fitted down over the insert 12 in a frictional engagement therewith and against the top edge of the box so as to form an enclosure for the box. The lid 14 is formed of the blank shown in FIG. 4.

Figure 2:
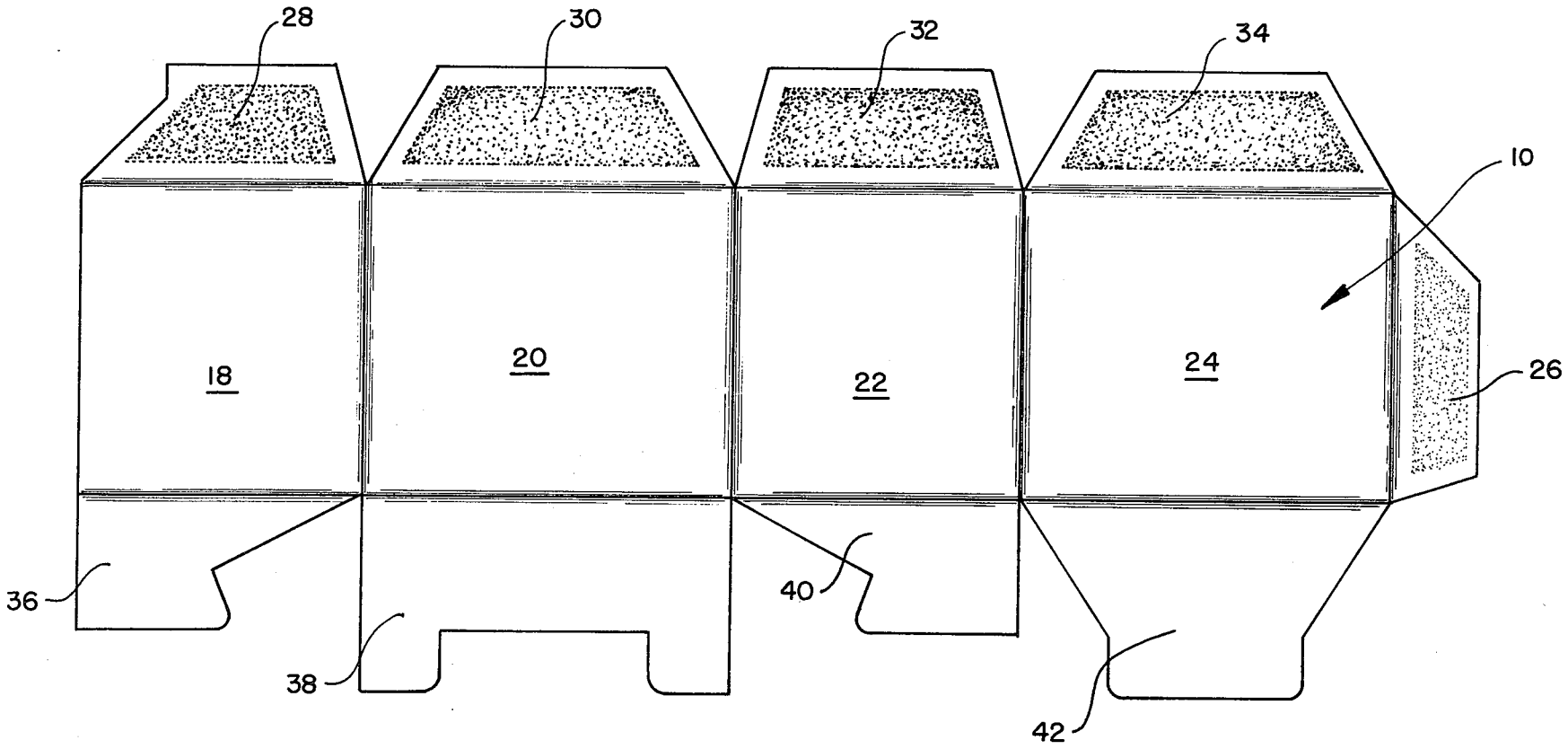
FIG. 2 is a top plan view of an appropriate blank, formed of paperboard, or other suitable material, which may be folded to constitute the box itself.

The blank of FIG. 2 forms the box 10. It includes four panels designated 18, 20, 22 and 24, separated by scorelines which permit the panels to be folded into a rectangular configuration. An end flap 26 is formed on the distal end of the panel 24, and a scoreline between the panel and the end flap permits the end flap to be folded against the top surface of the panel 18, when the blank is folded to its rectangular configuration. Glue is provided on the obverse side of the flap 26 so that the flap may be glued to the panel 18 in an appropriate gluing machine.

Top flaps 28, 30, 32 and 34 are provided at the tops of the respective panels 18, 20, 22 and 24. Glue is provided on the top surface of each of the latter flaps, to enable the flaps to be bent down against the corresponding panels and glued in place.

Bottom flaps 36, 38, 40 and 42 of the illustrated configurations are provided at the bottom edges of the corresponding panels 18, 20, 22 and 24. The flaps 36, 38, 40 and 42 may be interleaved with one another to form a bottom for the box 10 when the panels 18, 20, 22 and 24 are folded into the rectangular configuration of FIG. 1.

Figure 3:
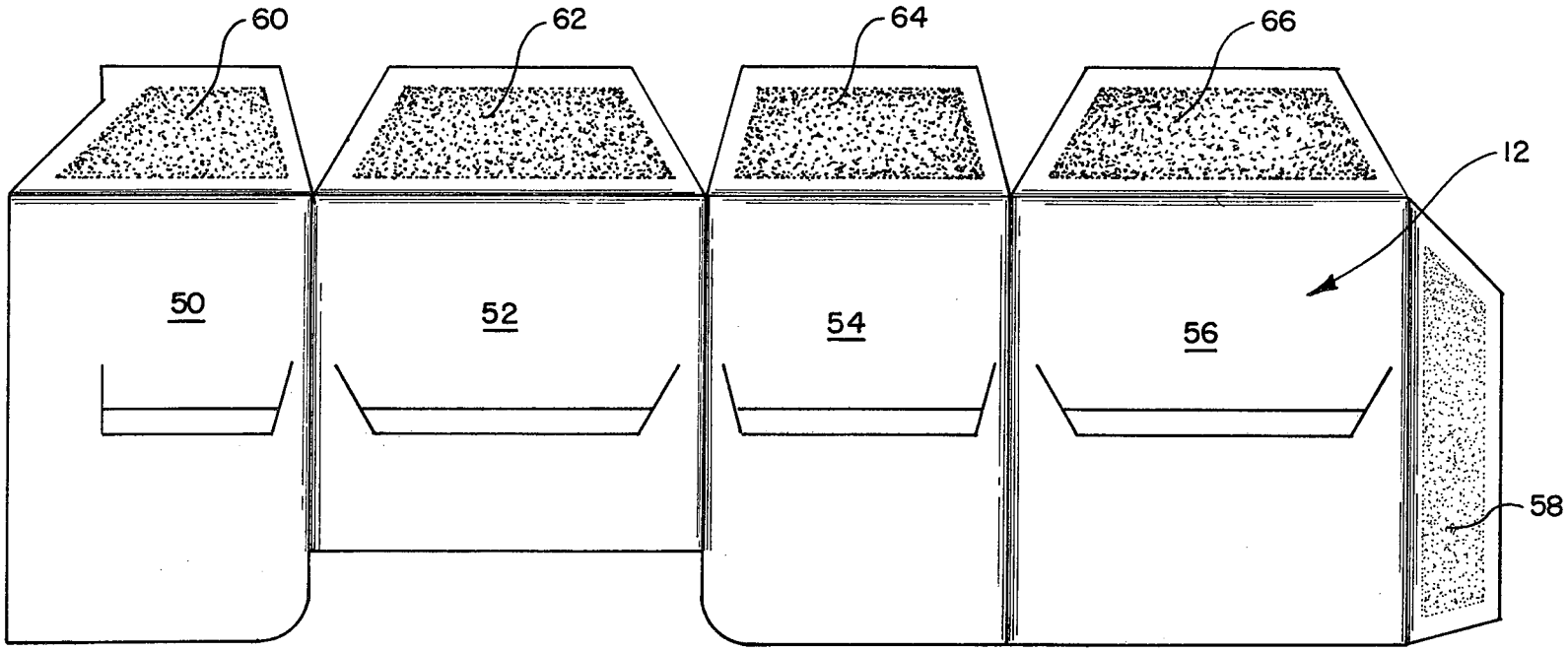
FIG. 3 is a top plan view of an appropriate blank, likewise formed of paperboard or other suitable material, which may be folded to constitute an insert for the box of FIG. 2.

The insert blank 12 of FIG. 3 has four panels 50, 52, 54 and 56. An end flap 58 is attached to the end of the panel 56, and an intermediate scoreline permits the flap 58 to be folded down over part of the face of the panel 50 when the insert is folded to the rectangular configuration of FIG. 1. Scorelines between the individual panels permit the insert to be folded into its rectangular configuration. The flap 58 has glue formed on its reverse side to permit the flap to be glued to the face of the panel 50 when the insert is in its rectangular configuration. Top flaps 60, 62, 64 and 66 are attached to the respective panels 50, 52, 54 and 56, and intermediate scorelines are provided to permit the top flaps to be folded down over the corresponding panels. The face of each of the top flaps have glue formed thereon to permit the flaps to be glued down over the respective panels.

As illustrated, each of the panels 50, 52, 54 and 56 has a intermediate slot and perforation, so that the lower edge of each slot may engage the edges of the flaps 28, 30, 32 and 34 of the box 10 of FIG. 2, when the insert of FIG. 3 is in the box, as shown in FIG. 1, so as to provide a means for retaining the insert within the box.

Figure 4:
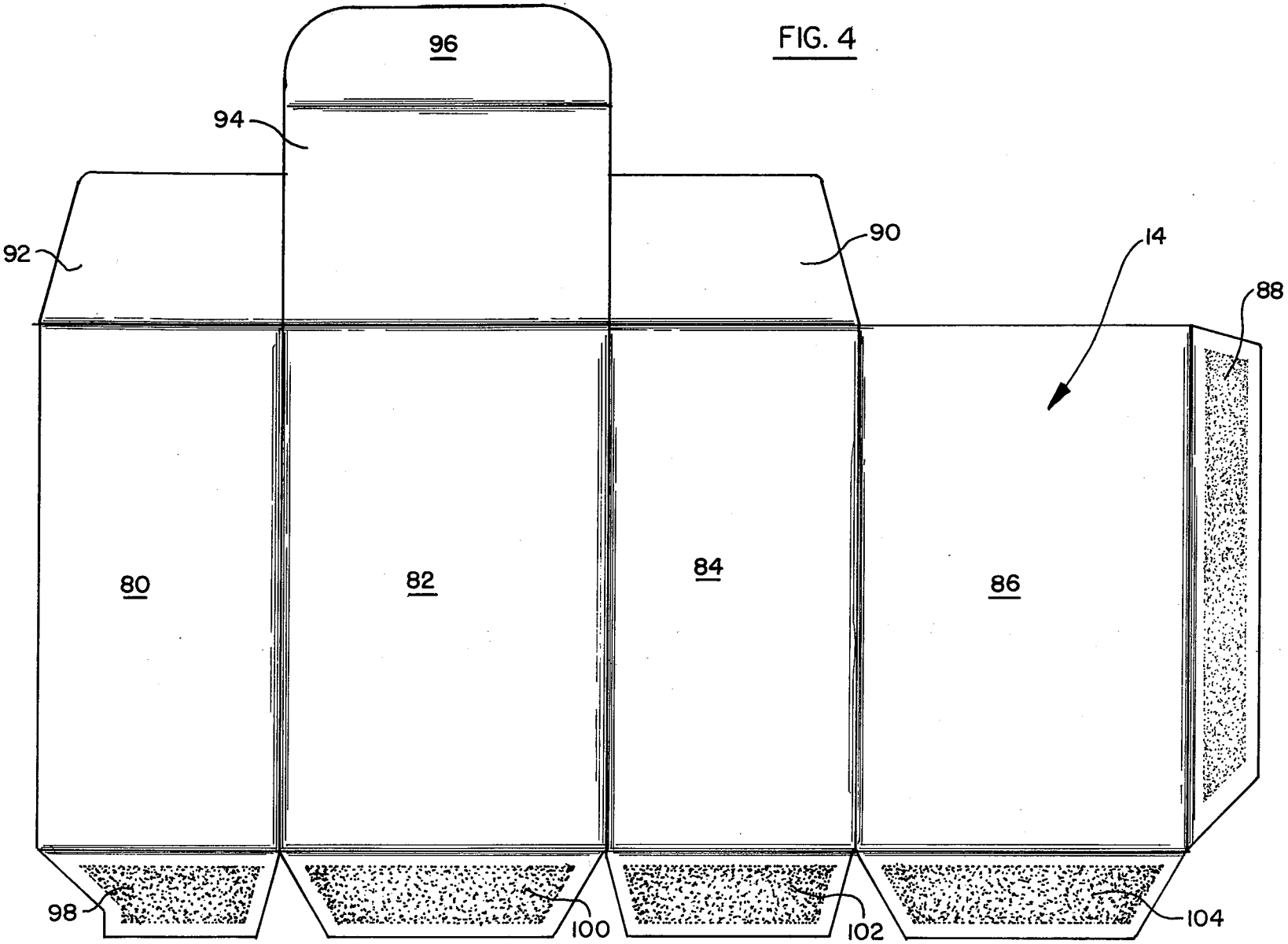
FIG. 4 is a top plan view of an appropriate blank, which may also be formed of paperboard, or other suitable material, and which may be folded to constitute a lid for the box of FIG. 2.

The blank for lid 14, as shown in FIG. 4 has four panels 80, 82, 84 and 86, with intermediate scorelines to permit the panels to be folded into the rectangular configuration of FIG. 1. An end flap 88 is provided at the edge of the panel 86, and has glue on its obverse side. A scoreline separates the flap 88 from the panel 86, permitting it to be folded down against the face of the panel 80, when the lid is in its rectangular configuration and glued in place. Top flaps 90 and 92 are formed adjacent the top edges of the panels 80 and 84, and interposed scorelines permit the top flaps to be folded over when the lid is in the configuration of FIG. 1.

A cover 94 is provided adjacent the top edge of the panel 82, and an appropriate scoreline permits the cover to be folded over the flaps 90 and 92 to the position shown in FIG. 1 to close the top of the lid. A flap 96 is provided at the upper edge of the cover, which may be folded down between the forward edge of the cover and the panel 86, when the box 10 is in the configuration of FIG. 1, so as to hold the cover in place.

Bottom flaps 98, 100, 102 and 104 (FIG. 4) are provided at the lower edges of the panels 80, 82, 84 and 86 which may be folded over and glued to the faces of the corresponding panels.

The invention provides, therefore, three blanks which may be used to form a box by means of a minimum of folding operations, and with a minimum of gluing.

It will be appreciated that although a particular embodiment of the invention has been shown and described, modifications may be made. It is intended in the following claims to cover the modifications which come within the true spirit and scope of the invention.

What is claimed is:

1. Three blanks for forming a generally rectangular box with a detachable rectangular lid, the first of the blanks serving to form the box and comprising four adjacent rectangular panels separated from one another by respective scorelines to permit the panels to be folded into a rectangular shape, an end flap attached to the distal edge of an end of one of the panels to be glued to the other end panel to hold the first blank in its rectangular configuration, and bottom flaps attached to the lower edges of the panels and separated therefrom by corresponding scorelines to permit the bottom flaps to be folded over and constitute a bottom for the box; a second of the blanks serving to form an insert for the box protruding upwardly from the upper edge thereof and comprising four adjacent rectangular panels separated from one another by respective scorelines to permit the last-named panels to be folded into a rectangular open-ended shape, and an end flap attached to the distal end of an end one of the last-named panels to be glued to the other end one of the last-named panels to hold the insert in its rectangular shape; and a third of the blanks serving to form a lid for the box and comprising four adjacent rectangular panels separated from one another by respective scorelines to permit the last-named panel to be folded into a rectangular lid to fit over the protruding portion of the insert and against the upper edge of the box, said third blank having an end flap attached to the distal end of an end one of the last-named panels to be glued to the other end one of the last-named panels to hold the lid in its rectangular shape, and said third blank also having at least one flap attached to the upper edge of at least one of the last-named panels and separated therefrom by a scoreline to permit the last-named flap to be folded over to constitute a cover for the lid.

2. The assembly of claim 1, in which the bottom flaps of the first blank serving to form the box are shaped to interleave with one another.

3. The assembly of claim 1, in which the first blank serving to form the box includes four flaps attached to the upper edges of the panels and respectively separated from the panels by corresponding scorelines to permit the flaps to be folded against and glued to the corresponding panels; and in which the panels of the second blank serving to form the insert have cut out portions shaped to engage the lower edges of the last-named flaps to hold the insert in the box.

4. The assembly of claim 1, in which the second blank serving to form the insert has four flaps attached to the upper edges of the panels thereof and respectively separated therefrom by corresponding scorelines which permit the flaps to be folded against and glued to the corresponding panels.

5. The assembly of claim 1, in which the third blank serving to form the lid has four flaps attached to the lower edges of the panels thereof and respectively separated therefrom by corresponding scorelines which permit the flaps to be folded against and glued to the corresponding panels.

* * * * *